US007949275B2

(12) United States Patent
Kato

(10) Patent No.: US 7,949,275 B2
(45) Date of Patent: May 24, 2011

(54) CLEANING DEVICE, PROCESS CARTRIDGE AND IMAGE FORMING APPARATUS

(75) Inventor: Masahiko Kato, Yokohama (JP)

(73) Assignee: Ricoh, Ltd., Tokyo (JP)

( * ) Notice: Subject to any disclaimer, the term of this patent is extended or adjusted under 35 U.S.C. 154(b) by 287 days.

(21) Appl. No.: 12/078,905

(22) Filed: Apr. 8, 2008

(65) Prior Publication Data

US 2008/0260410 A1 Oct. 23, 2008

(30) Foreign Application Priority Data

Apr. 12, 2007 (JP) ..... 2007-104878

(51) Int. Cl.
*G03G 15/00* (2006.01)
*G03G 21/00* (2006.01)

(52) U.S. Cl. ..... 399/71; 399/350; 399/351

(58) Field of Classification Search ..... 399/34, 399/71, 123, 149, 327, 343, 350, 111, 351
See application file for complete search history.

(56) References Cited

U.S. PATENT DOCUMENTS 5,021,825 A * 6/1991 Niki ..... 399/111
5,842,081 A * 11/1998 Kaname et al. ..... 399/50
6,128,461 A * 10/2000 Yoshikawa ..... 399/350
7,123,872 B2 * 10/2006 Shakuto et al. ..... 399/350

FOREIGN PATENT DOCUMENTS

JP 05-142887 6/1993
JP 06-051673 2/1994
JP 2671792 7/1997
JP 3097926 8/2000

OTHER PUBLICATIONS

English Language Abstract of JP 05-066782 dated Mar. 19, 1993.
English Language Abstract of JP 07-199731 dated Aug. 4, 1995.

* cited by examiner

*Primary Examiner* — David P Porta
*Assistant Examiner* — Faye Boosalis
(74) *Attorney, Agent, or Firm* — Harness, Dickey & Pierce, P.L.C.

(57) ABSTRACT

A cleaning device capable of inhibiting noise from being caused by stick-slip vibration between a blade member of the cleaning device and an image carrier, a process cartridge, and an image forming apparatus are provided. A vibration detecting device for detecting a vibration state is attached to a central part of a holder holding a blade member, and an excitation member for vibrating the blade member is attached to the blade member over the entire length thereof in a direction along a sliding contact surface contacting a photoreceptor.

12 Claims, 9 Drawing Sheets

CLEANING DEVICE, PROCESS CARTRIDGE AND IMAGE FORMING APPARATUS

BACKGROUND OF THE INVENTION

1. Field of the Invention

The present invention relates to a cleaning device, a process cartridge and an image forming apparatus. The present invention relates particularly to a cleaning device that has a blade member and a holder for holding the blade member—the blade member being a member for coming into sliding contact with the surface of an image carrier forming thereon a toner image and thereby cleaning toner remaining on the surface of the image carrier—a process cartridge, and an image forming apparatus that are provided with this cleaning device.

2. Description of the Related Art

A conventional image forming apparatus, such as a printer and a copier, uses various movable components, but there was a problem that these movable components cause vibration by themselves or by coming into sliding contact with each other, thereby causing noise around the image forming apparatus. For this reason, the vibration noise or contact noise caused by the various movable components are reduced using an acoustic material, a sound insulator, a damping material and the like.

For example, the following idea is proposed: in order to reduce the noise generated by the rotation of a drive motor used in the image forming apparatus, a vibration pickup is attached to the drive motor installed within the image forming apparatus, and a noise-erasing space surrounding body with a noise-erasing space is formed to cover around the drive motor including the vibration pickup and seal the noise generated by the drive motor in the noise-erasing space. Then, a noise-erasing speaker for generating a sound in the waveform opposite to the noise waveform of the drive motor is disposed within the noise-erasing space of the noise-erasing space surrounding body, and the noise-erasing speaker is caused to generate the sound in the waveform opposite to the noise waveform of the drive motor, whereby the noise generated by the drive motor can be canceled efficiently (see, for example, Japanese Published Unexamined Patent Application No H5-142887).

However, in the image forming apparatus, noise is generated from other components besides the drive motor, even from a cleaning device that comes into sliding contact with the surface of an image carrier forming a toner image thereon and thereby cleans toner remaining on the surface of the image carrier. Specifically, there is a problem that stick-slip occurs due to the friction between a blade member of the cleaning device and the image carrier, and vibration caused by this stick-slip becomes the source of causing high-pitched noise from the image carrier. There is also another problem that the vibration is propagated from the blade member of the cleaning device to a unit chassis to generate noise.

It is difficult to sufficiently cancel such noise caused by the stick-slip vibration between the blade member of the cleaning device and the image carrier, even when the noise-erasing speaker described in Japanese Published Unexamined Patent Application No HS-142887 is used. Technologies relating to the present invention are also disclosed in, e.g., Japanese Patent Application No. 2,671,792 and Japanese Patent Application No. 3,097,926.

SUMMARY OF THE INVENTION

The present invention was contrived in view of the above problems, and an object of the present invention is to provide a cleaning device capable of inhibiting noise from being caused by stick-slip vibration between a blade member of the cleaning device and an image carrier, and to provide a process cartridge and an image forming apparatus.

In an aspect of the present invention, a cleaning device comprises a blade member that comes into sliding contact with a surface of an image carrier forming thereon a toner image and thereby cleans toner remaining on the surface of the image carrier; and a holder for holding the blade member. A vibration detection device that detects vibration of the blade member and an excitation member that vibrates the blade member are attached to the blade member or the holder, and the cleaning device further comprises a control device that causes the excitation member to vibrate the blade member or the holder when the level of vibration detected by the vibration detection device exceeds a set threshold value.

In another aspect of then present invention, there is provided with a process cartridge to which are integrally attached an image carrier forming thereon a toner image, and a cleaning device having a blade member coming into sliding contact with a surface of the image carrier to clean toner remaining at least on the surface of the image carrier and a holder for holding the blade member. A vibration detection device that detects vibration of the blade member and an excitation member that vibrates the blade member are attached to the blade member or the holder. The cleaning device further comprises a control device that causes the excitation member to vibrate the blade member or the holder when the level of vibration detected by the vibration detection device exceeds a set threshold value.

In another aspect of the present invention, an image forming apparatus comprises an image carrier forming thereon a toner image, and a cleaning device that has a blade member coming into sliding contact with a surface of the image carrier to clean toner remaining on the surface of the image carrier and a holder for holding the blade member. A vibration detection device that detects vibration of the blade member and an excitation member that vibrates the blade member are attached to the blade member or the holder. The cleaning device further comprises a control device that causes the excitation member to vibrate the blade member or the holder when the level of vibration detected by the vibration detection device exceeds a set threshold value.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENTS

In an image forming apparatus, normally a cleaning device is essential for removing residual toner, and it is desired that noise of the cleaning device be reduced. Stick-slip is the source of the noise. The mode of stick-slip vibration is the self-excited vibration, which is an unstable mode according to eigenvalue analysis due to uncertainty as to occurrence or non-occurrence of vibration. This unstable mode varies according to the level of contact and sliding occurring between a blade member of the cleaning device and an image carrier, but the unstable mode occurs or does not occur due to a combination of various situations including changes in physical property value of the blade caused by changes in the temperature or humidity within the image forming apparatus, time degradation of the blade member of the cleaning device, and adhesion conditions of toner on the image carrier. Therefore, even in an image forming apparatus with the same configuration, vibration noise can be caused by sudden stick-slip, or vibration noise might or might not be caused depending on the environment where the image forming apparatus is installed. The unstable mode causing such situations can be avoided simply by slightly changing the level of contact and sliding.

Therefore, in order to avoid a situation in which the unstable mode is caused, without changing an abutting angle or the like of a blade member of an optimized cleaning device, the present invention was designed to prevent the occurrence of vibration noise by using an excitation member to apply high-frequency vibration to the blade member of the cleaning device or to a holder that holds the blade member and change the level of contact and sliding.

Hereinafter, embodiments of the present invention will be described in detail with reference to the drawings.

Figure 1:
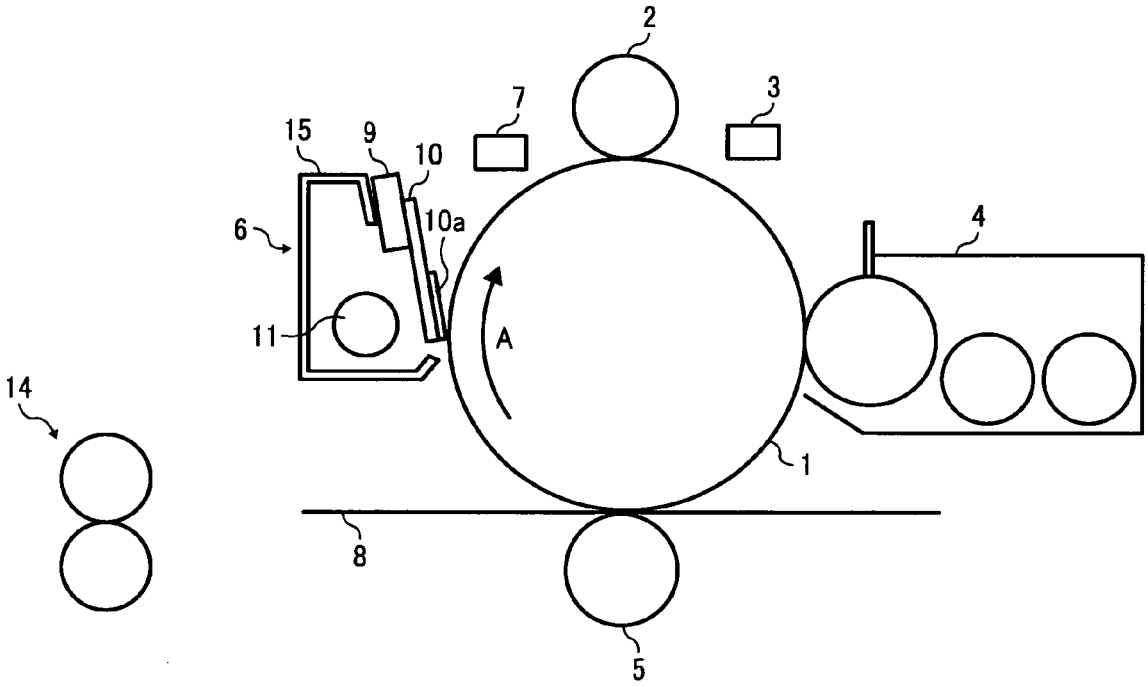
FIG. 1 is a cross-sectional view showing a schematic configuration of an image forming apparatus according to a first embodiment of the present invention.

FIG. 1 shows a schematic configuration of the substantial parts of the image forming apparatus according to the first embodiment of the present invention. The image forming apparatus of the present embodiment has a drum-like photoreceptor 1, which is an image carrier rotating in the direction of the arrow A, and charging means 2, exposure means 3, developing means 4, transfer means 5, a cleaning device 6, and destaticizing means 7 are disposed around the photoreceptor 1. Furthermore, there is disposed a fixing device 14 for heating, pressing and fixing a toner image formed on a transfer material 8, such as a transfer sheet, that is transferred from the photoreceptor 1.

The charging means 2 is disposed on the surface of the photoreceptor 1 in contact or non-contact with the photoreceptor 1 by a predetermined distance. The charging means 2 applies bias to charge the photoreceptor 1 to a predetermined polarity or a predetermined potential. The exposure means 3 uses an LD (Laser Diode) or an LED (Light Emission Diode) as a light-emitting element, and emits light to the photoreceptor 1 based on image data to form an electrostatic latent image.

The developing means 4 has a magnetic roller fixed therein and a rotatable developer carrier and causes the developer carrier to hold developer. In the present embodiment, the two-component magnetic brush development system is used by using, as the developer, two-component developer composed of toner and carrier. As another development system, the one-component development system may be used in which the carrier is not used. Voltage is applied from a development bias power source, not shown, to the developer carrier. With a potential difference between the development bias and the potential of the electrostatic latent image formed on the surface of the photoreceptor 1, charged toner is adhered to the electrostatic latent image in a developing region, and development is performed.

The transfer means 5, at the time of transfer, comes into contact with the surface of the photoreceptor 1 at predetermined pressing force, and, with the application of voltage, transfers the toner image formed on the surface of the photoreceptor 1 to the transfer material 8 at a transfer nip portion formed between the photoreceptor 1 and the transfer means 5. In the present embodiment the transfer is performed using a transfer roller. Transfer means such as a scorotron and a transfer belt may be used. The destaticizing means 7 is for destaticizing residual charge on the photoreceptor 1 obtained as a result of removing residual toner using the cleaning device 6, and is an optical destaticizing system in which an LED or the like is used.

The cleaning device 6 shown in FIG. 1 is configured by a holder 9, a blade member 10, a case 15 for attaching the holder 9, and the like, and removes the residual toner from the surface of the photoreceptor 1 by pressing the blade member 10 against the photoreceptor 1. The toner that is removed from the surface of the photoreceptor 1 by the cleaning device 6 is accumulated in the case 15, stored as waste toner in an unshown waste toner bottle by a toner conveyance member 11, and recovered by a service man or carried to a developing device or the like as recycled toner so as to be used for development.

In such cleaning device 6 with this configuration, it is known that stick-slip occurs between the blade member 10 and the photoreceptor 1. Due to stick-slip, the blade member 10 and photoreceptor 1 of the cleaning device 6 are excited and perform acoustic radiation, whereby noise is generated. Particularly when the photoreceptor 1 resonates or when the blade member 10 of the cleaning device 6 resonates and thereby the excitation force against the photoreceptor 1 increases, large noise is generated. The mode of stick-slip vibration is the self-excited vibration, which is the unstable mode according to eigenvalue analysis due to uncertainty as to occurrence or non-occurrence of vibration.

This unstable mode varies according to the level of contact and sliding occurring between the blade member 10 of the cleaning device 6 and the photoreceptor 1, but the unstable mode occurs or does not occur due to a combination of various situations including changes in physical property value of the blade caused by changes in the temperature or humidity within the image forming apparatus, time degradation of the blade member 10 of the cleaning device 6, and adhesion conditions of the toner on the photoreceptor 1. Therefore, even in an image forming apparatus with the same configuration, vibration noise can be caused by sudden stick-slip, or vibration noise might or might not be caused depending on the environment where the image forming apparatus is installed. The unstable mode causing such situations depends on the changes in the level of contact and sliding and thus can be avoided simply by changing the level of contact and sliding. When crying noise of the blade member 10 occurs, normally the holder 9 and the blade member 10 are vibrated significantly.

Figure 2:
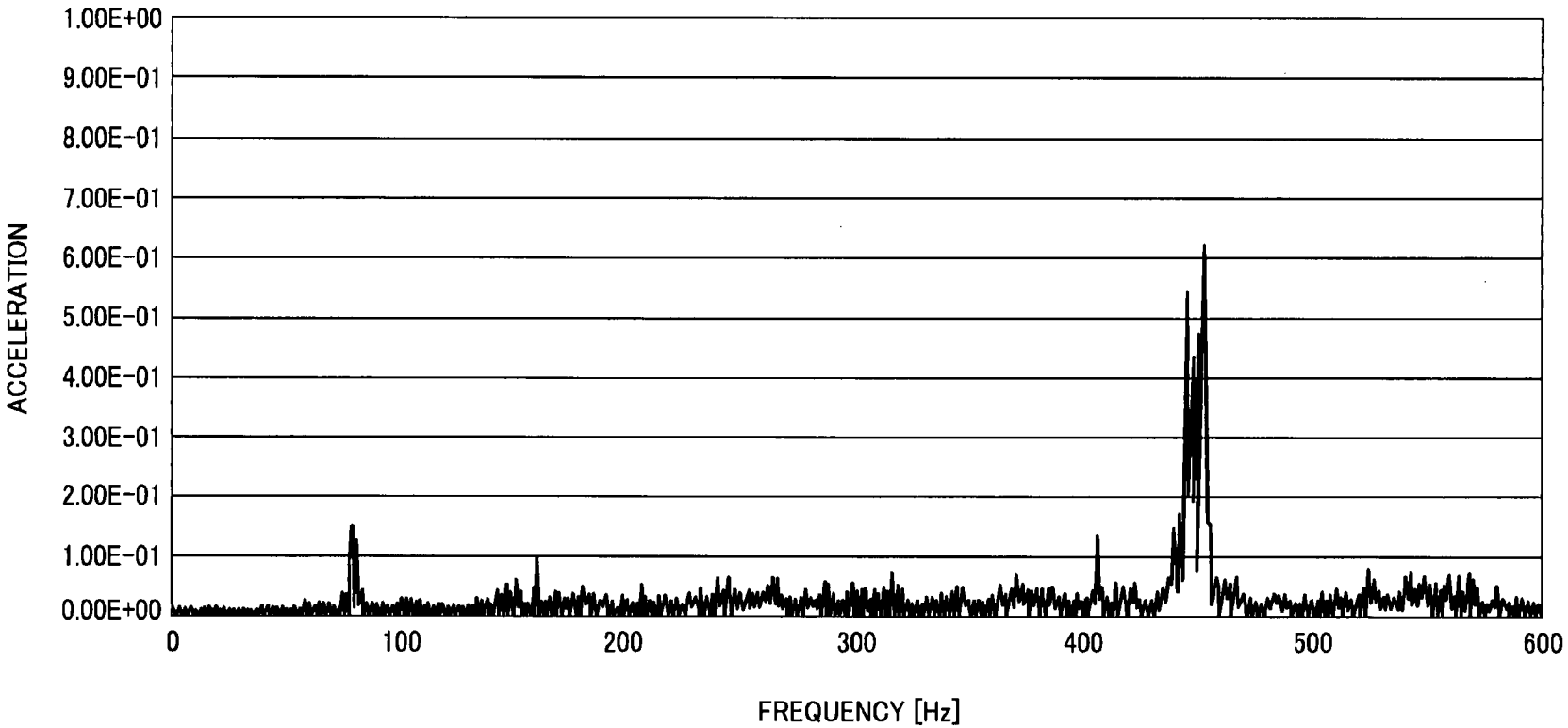
FIG. 2 PRIOR ART
FIG. 2 is a graph showing the vibration characteristics for the situation where vibration is caused by stick-slip in a cleaning device of a conventional image forming apparatus.
Figure 3:
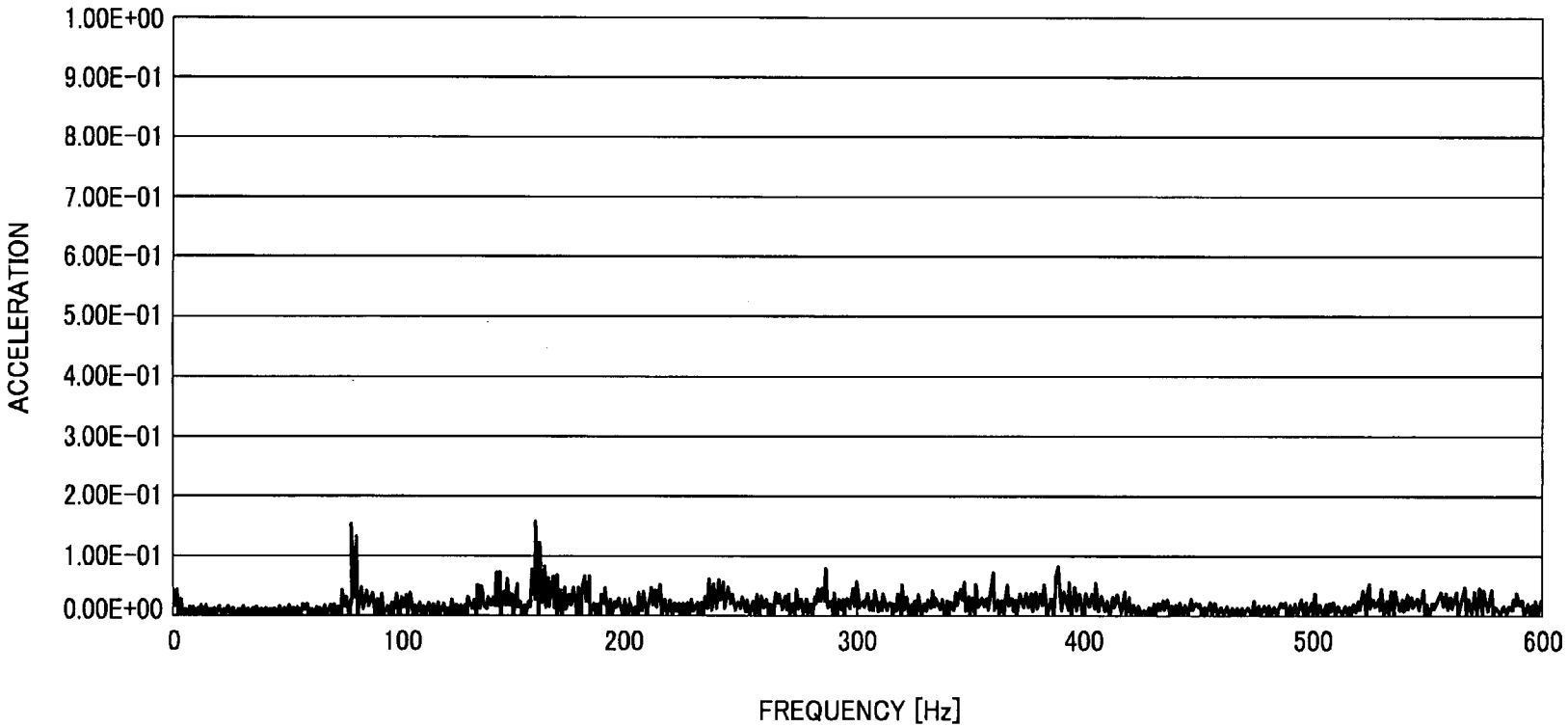
FIG. 3 PRIOR ART
FIG. 3 is a graph showing the vibration characteristics for the situation where vibration is not caused by stick-slip in the cleaning device of the conventional image forming apparatus.

FIG. 2 shows a conventional example the vibration state of the holder 9 that is measured when noise is caused, while FIG. 3 shows the vibration state measured when noise is not caused. As is clear from the results shown in FIG. 2 and FIG. 3, when the noises are compared, a large peak is observed at approximately 450 Hz in FIG. 2 when noise is caused due to stick-slip vibration. On the other hand, in the vibration state shown in FIG. 3 where noise is not generated, a large peak is not observed.

Figure 4:
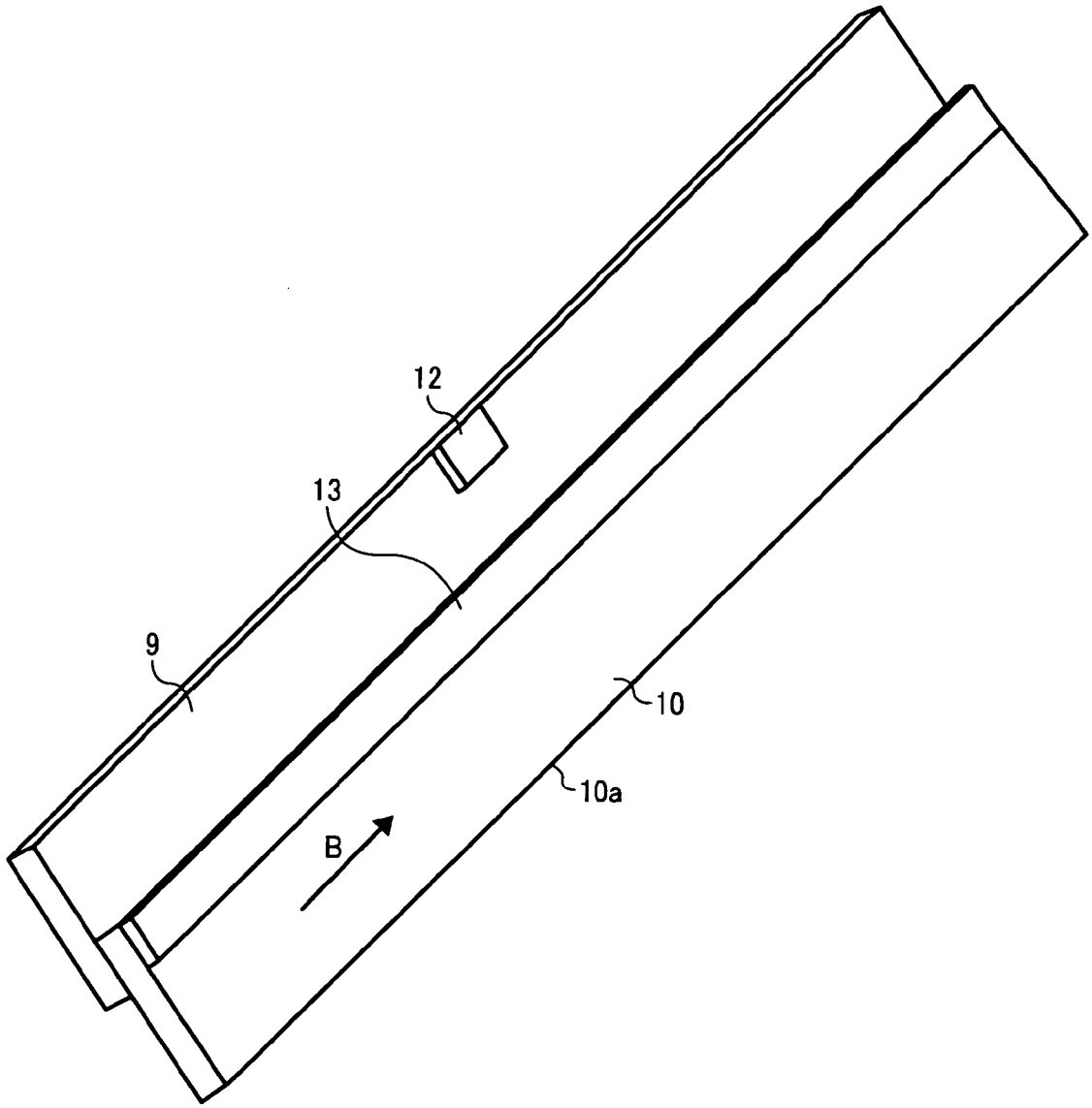
FIG. 4 is a perspective view showing the structure of a holder, a blade member, vibration detecting means and an excitation member of the cleaning device according to the first embodiment of the present invention.

In the present embodiment, therefore, even when stick-slip vibration occurs, the occurrence of vibration noise is prevented by using an excitation member 13 to apply high-frequency vibration to the blade member 10 of the cleaning device 6 to change the level of contact and sliding, as shown in FIG. 4. As shown in FIG. 4, vibration detecting means 12 for detecting the vibration state is attached to a central part of the holder 9 holding the blade member 10, and the excitation member 13 for vibrating the blade member 10 is attached to the blade member 10 over the entire length thereof in a direction along a sliding contact surface 10*a* contacting the photoreceptor 1 (direction of the arrow B). In the present embodiment the vibration detecting means 12 and the excitation member 13 are attached to the holder 9 and the blade member 10 respectively, as shown in FIG. 4, but the vibration detecting means 12 may be attached to the blade member 10 and the excitation member 13 to the holder 9. Moreover, in the present embodiment the excitation member 13 is attached to the blade member 10 over the entire length thereof in the direction along the sliding contact surface 10*a* contacting the photoreceptor 1 (direction of the arrow B), but the excitation member 13 does not have to extend the entire length and thus may be attached to a part of the blade member 10 such as a central part thereof where stick-slip occurs easily. However, when attaching the excitation member 13 over the entire length, the sliding contact surface 10*a* between the blade member 10 and the photoreceptor 1 can be vibrated evenly. Therefore, attachment of the excitation member 13 in this manner is preferred in terms of preventing the occurrence of a cleaning failure caused by partial excitation.

Figure 5:
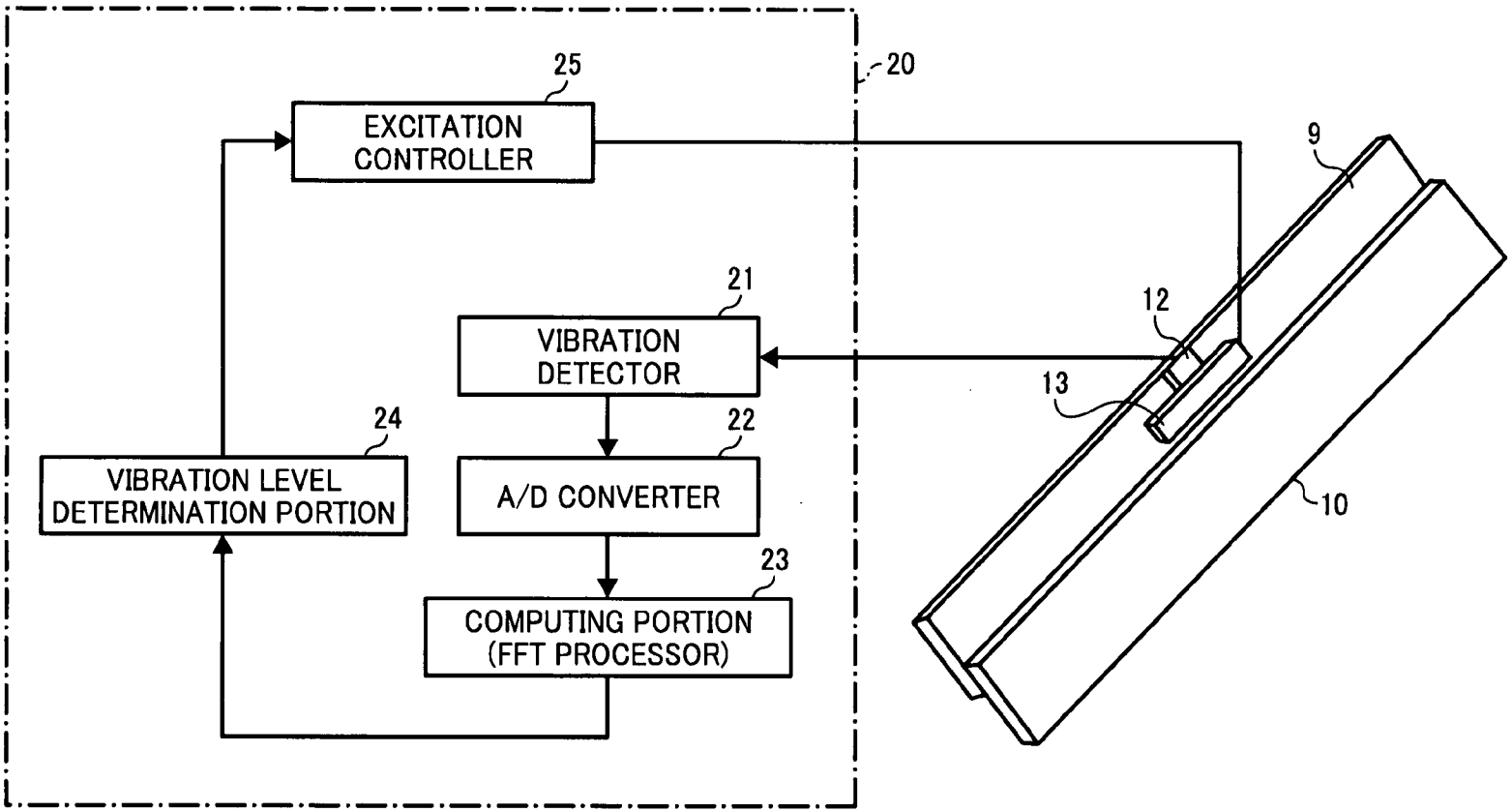
FIG. 5 is a block diagram showing a vibration control unit of the cleaning device according to the first embodiment.

The vibration detecting means 12 and the excitation member 13 that are attached as shown in FIG. 4 are connected to a vibration control unit 20 shown in FIG. 5. In the vibration control unit 20, vibration detected by the vibration detecting means 12 is sent to a vibration detector 21, and the vibration detector 21 time-sequentially outputs the intensity of the vibration (acceleration) as an analog signal. This output vibration intensity is converted into a digital signal by an A/D converter 22, computed by a computing portion 23, and sent to a vibration level determination portion 24 as an intensity of vibrational frequency. The vibration level determination portion 24 determines whether the level of the vibration detected by the vibration detecting means 12 exceeds a set threshold value. When the vibration level exceeds the threshold value, the vibration level determination portion 24 sends the exceeding amount of vibration intensity above the threshold to an excitation controller 25, and then the excitation member 13 is driven by the excitation controller 25 to vibrate the blade member 10. In this manner, the excitation member 13 vibrated by the control unit 20 vibrates the blade member 10, whereby the level of contact and sliding can be slightly changed to prevent self-excited vibration. Accordingly, noise caused by the vibration can be reduced.

A piezoelectric element can be used as the vibration detecting means 12 for detecting the vibration state, which is shown in FIG. 4. A piezoelectric element is characterized in generating a voltage when applied with pressure, and deforming when applied with a voltage. Therefore, when vibration occurs, the piezoelectric element is applied with force and thereby generates a voltage, hence the vibration state can be detected by measuring the generated voltage. When the piezoelectric element is used as the vibration detecting means 12, it can be installed in the cleaning device 6 or other member without requiring a large space, and the generated vibration can be measured quantitatively.

Furthermore, the piezoelectric element can be used as the excitation member 13 by taking advantage of the properties for deforming when applied with a voltage. It is advantageous to use the piezoelectric element as the excitation member 13 because it is capable of not only providing high response against an excitation signal, but also performing excitation on a wide frequency band. In addition, the piezoelectric element can be formed in any thickness or shape, and the place on the blade member 10 to install the piezoelectric element is less limited. Any installation method may be used as long as the holder 9 or the blade member 10 can be bent or vibrated, and epoxy adhesive or other adhesive may be used for adhering the piezoelectric element onto the holder 9 or the blade member 10 to realize easy attachment. Also, the positions of the vibration detecting means 12 and excitation member 13 are not limited and may be any position as long as the vibration of the entire blade member 10 can be controlled. Moreover, when using the piezoelectric element as the excitation member 13, it is preferred that an excitation frequency be 20 kHz or higher. The reason is that, since the audible frequency range of human is approximately not more than 20 kHz, vibration caused by the excitation of the piezoelectric element does not sound as noise.

Furthermore, the frequency for forcibly vibrating the blade member 10, that is, a frequency of at least 1500 Hz, is sufficient to vibrate the excitation member 13. However, in the case of a vibration frequency of 20 kHz or lower, which is the audible frequency range of human, vibration caused by the excitation member 13 might sound as noise to a user, and thus it is preferred that the vibration frequency be over 20 kHz. The direction of vibration of the blade member 10 caused by the excitation member 13 may be any direction, but particularly when the vibration caused by the excitation member 13 expands in a direction in which the blade member 10 of the cleaning device 6 moves toward the photoreceptor 1 (direction of the arrow C) as shown in FIG. 6, such vibration is preferred in terms of improving the cleaning effect because noise caused by stick-slip can be reduced by changing the sliding contact state between the blade member 10 of the cleaning device 6 and the photoreceptor 1, and because the effect of brushing off the residual toner from the photoreceptor 1 can be achieved.

Figure 6:
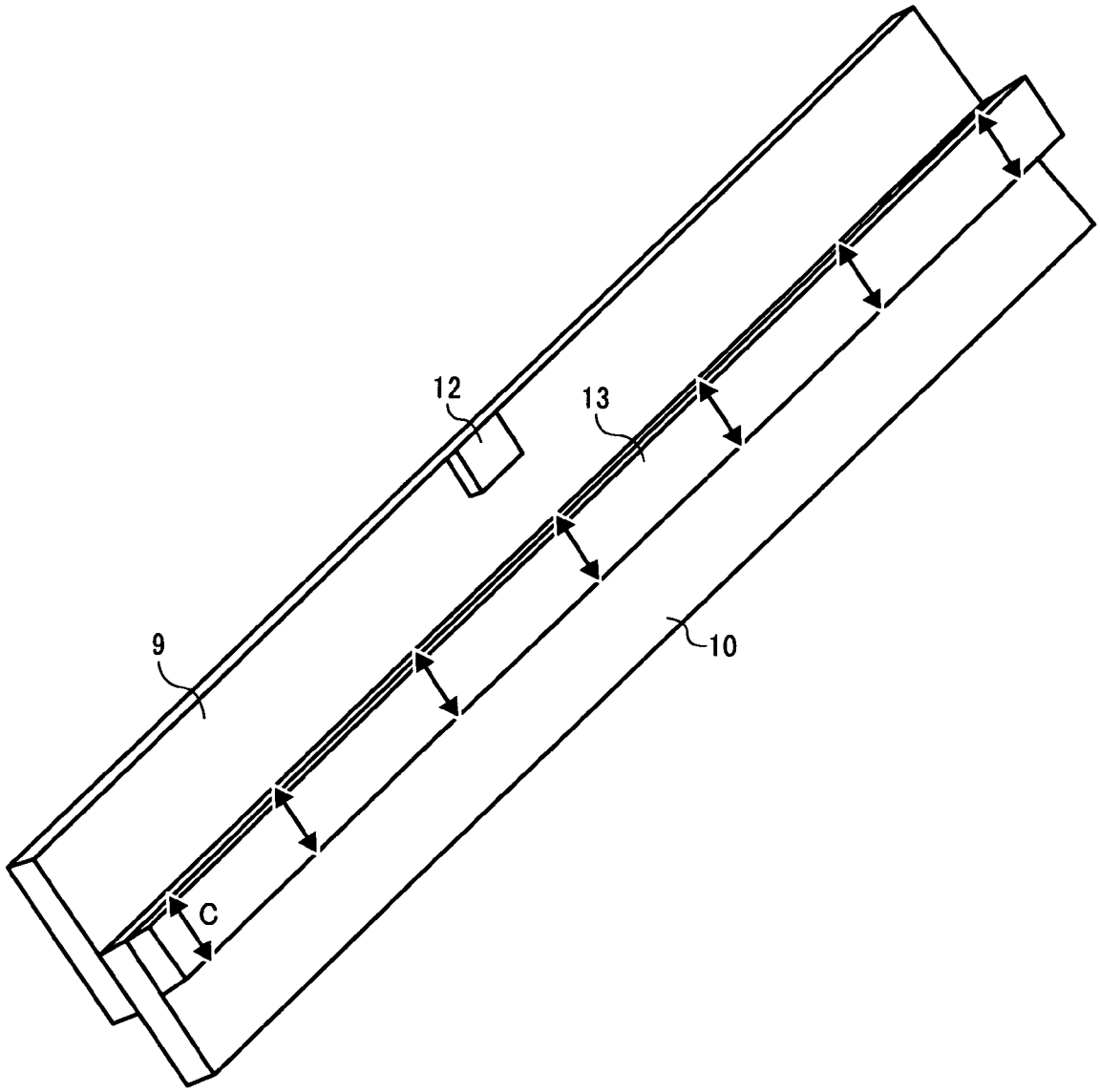
FIG. 6 is a perspective view showing the direction of vibration of the excitation member of the cleaning device according to the first embodiment.
Figure 7:
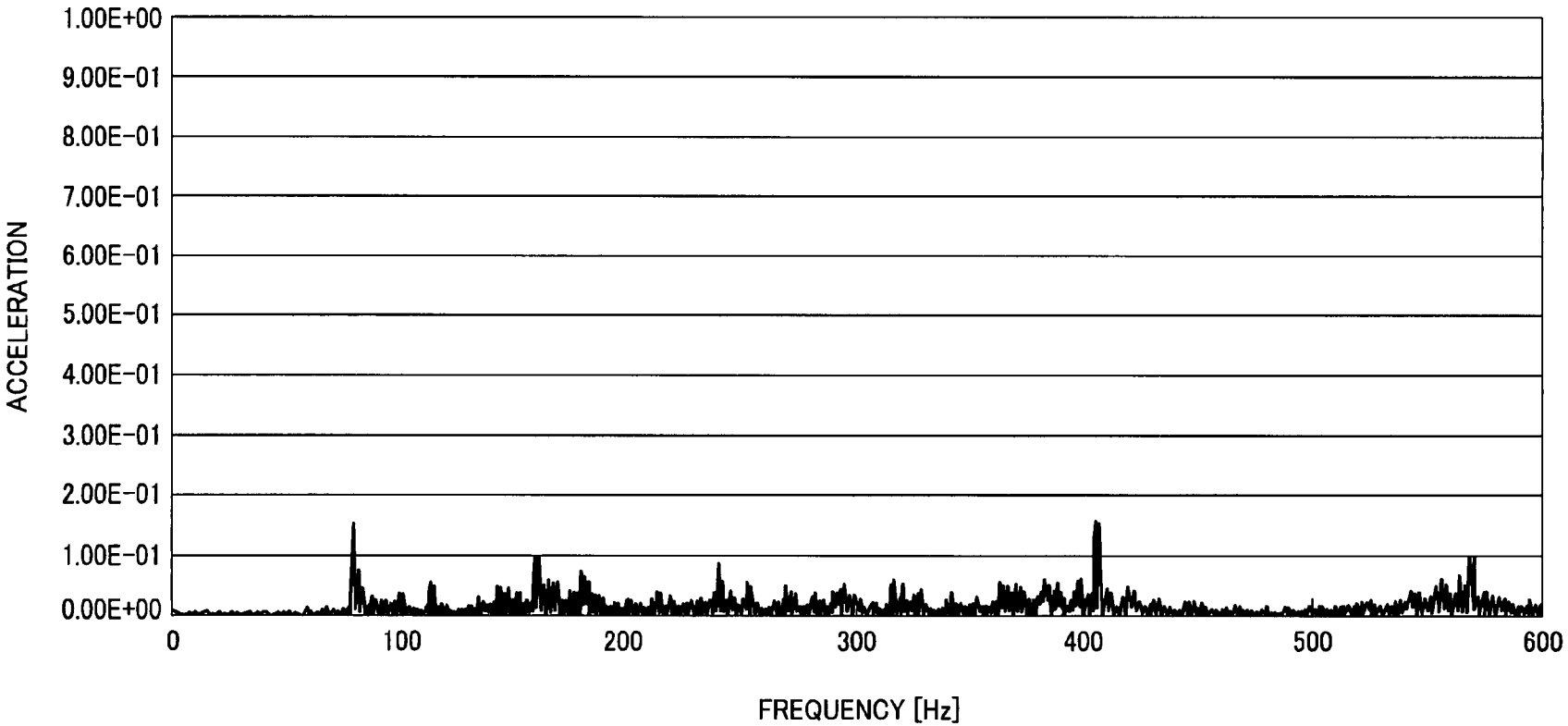
FIG. 7 is a graph showing the vibration characteristics of vibration caused in the cleaning device according to the first embodiment.

Incidentally, when the vibration detecting means 12 and the excitation member 13 of FIG. 6 that are each constituted by a piezoelectric element were attached to the cleaning device 6 that causes vibration shown in FIG. 2, and when the vibration control unit 20 shown in FIG. 5 was used for performing excitation at a frequency of 20 kHz to control the vibration, the peak vibration of approximately 450 Hz was eliminated and thus occurrence of noise was not observed.

As described above, in the cleaning device 6 of the present embodiment in which the vibration detecting means 12 is attached to the holder 9 and the excitation member 13 to the blade member 10, when a large vibration is detected by the vibration detecting means 12 the blade member 10 is vibrated by the excitation member 13, so that stick-slip that is caused between the blade member 10 and the surface of the photoreceptor 1 can be inhibited appropriately and the occurrence of noise can be reduced.

Next is described a process cartridge in which the cleaning device 6 described in the first embodiment is integrally formed with the photoreceptor 1 and which can be moved or removed, together with the photoreceptor 1, from a predetermined position of the image forming apparatus.

Figure 8:
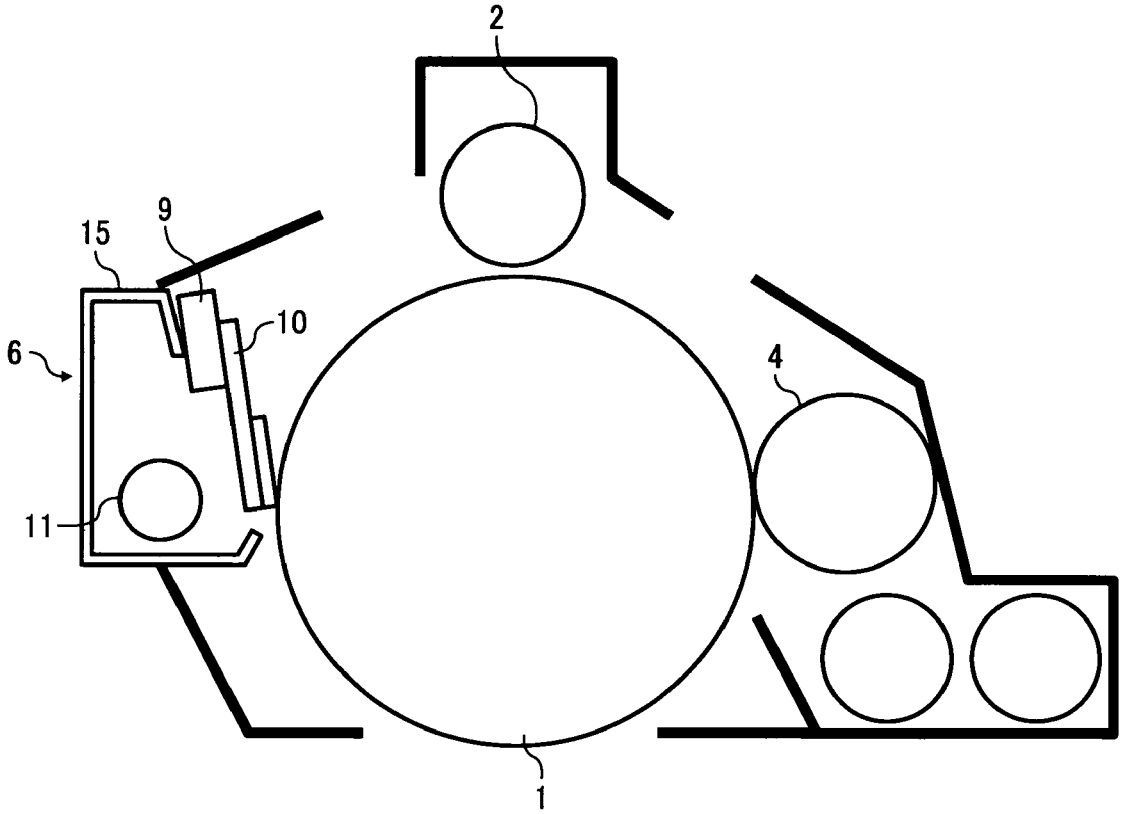
FIG. 8 is a cross-sectional view showing a schematic configuration of a process cartridge according to a second embodiment of the present invention.

FIG. 8 is a cross-sectional view showing a schematic configuration of a process cartridge that has the cleaning device of the second embodiment. The process cartridge of the present embodiment is configured by integrally combining the charging means 2, the developing means 4 and the cleaning device 6 around the photoreceptor 1. This process cartridge is configured so as to be detachable with respect to the image forming apparatus main body, such as a copier and a printer. By providing the detachable process cartridge with the cleaning device 6 in this manner, maintenance properties can be improved and integral replacement of the process cartridge can be performed easily.

Note in this case that in the cleaning device 6, the vibration detecting means 12 is attached to the holder 9 and the excitation member 13 to the blade member 10, as described in the first embodiment above. Therefore, the excitation member 13 detects vibration of the blade member 10 caused by the vibration detecting means 12, to eliminate stick-slip vibration of the blade member 10. Therefore, when this process cartridge is incorporated in the image forming apparatus to perform image formation processing, stick-slip vibration can be inhibited, and the occurrence of noise can be reduced.

Moreover, the present embodiment describes an example of configuring the process cartridge by integrally combining the photoreceptor 1, the charging means 2, the developing means 4 and the cleaning device 6, but the charging means 2 or the developing means 4 may not necessarily be integrated and thus may be configured separately, or additionally the destaticizing means 7 may be integrally configured.

Next is described an example applicable to a color image forming apparatus in which the process cartridge having the cleaning device is used.

Figure 9:
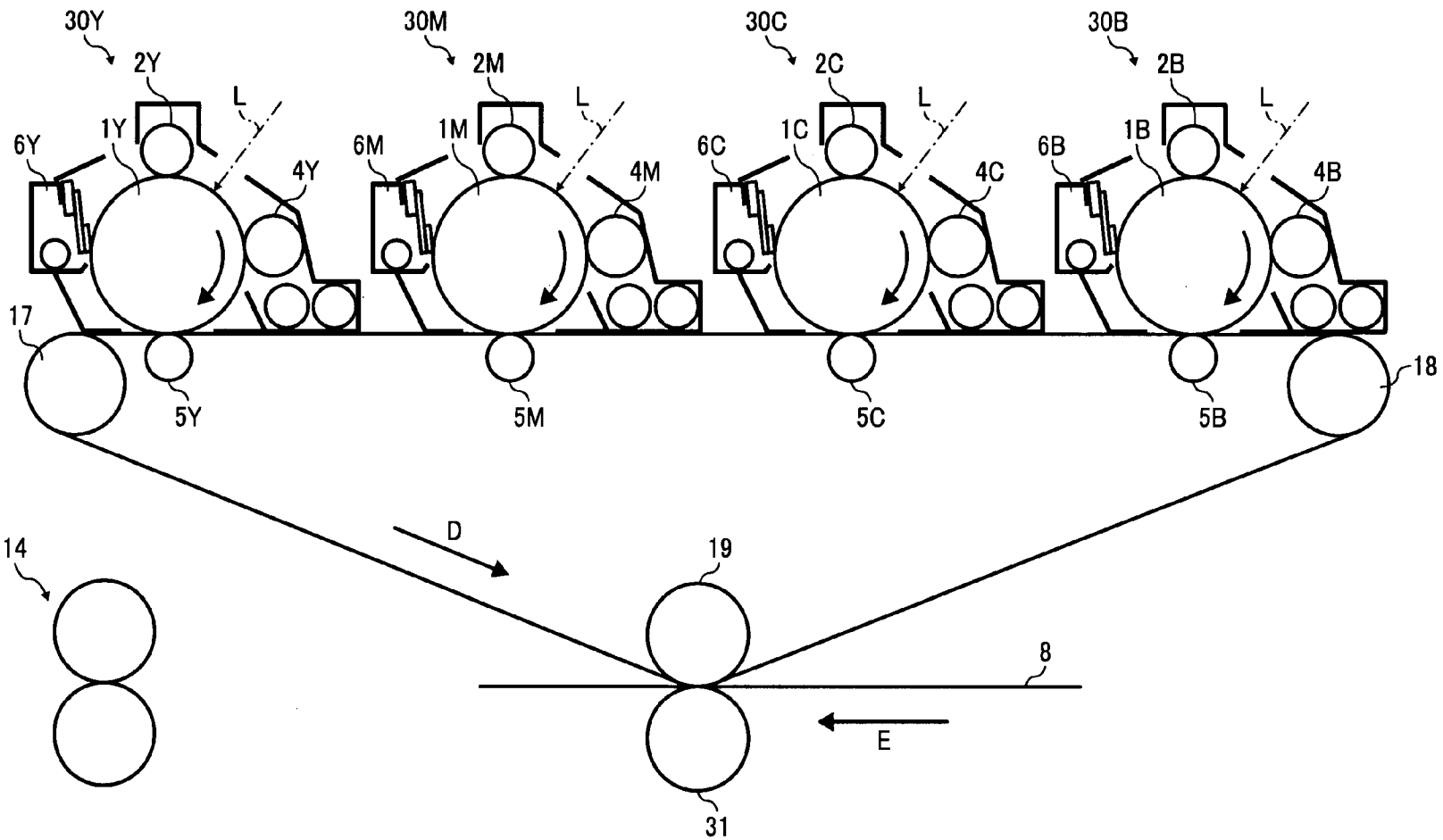
FIG. 9 is a cross-sectional view showing a schematic configuration of a color image forming apparatus according to the second embodiment.

FIG. 9 shows a color image forming apparatus in which process cartridges described above are arranged along a horizontally extending endless transfer belt 16 that is tightly stretched around rollers 17, 18, 19 and transferred in a direction of the arrow D. The process cartridges are configured as described above with reference to FIG. 8, and four of them corresponding to colors of yellow (Y), magenta (M), cyan (C) and black (B) are disposed. Incidentally, the photoreceptor, charging means, developing device, transfer means, and cleaning device contained in each process cartridge 30 of corresponding color are applied with reference numerals corresponding to each color, such as 1Y, 1M, 1C, 1B, 2Y, 2M, 2C, 2B, 4Y, 4M, 4C, 4B, 5Y, 5M, 5C, 5B, and 6Y, 6M, 6C, 6B. Also, exposure performed on each color by the exposure means is shown by reference numeral L. The toner images on the photoreceptors that are developed by the process cartridges 30Y, 30M, 30C, 30B respectively are transferred successively to the horizontally extending transfer belt 16 applied with a transfer voltage. In this manner, yellow, magenta, cyan and black images are formed, multiply-transferred onto the transfer belt 16, and then collectively transferred to the transfer material 8 in a direction of the arrow E by secondary transfer means 31. Thereafter, the multiply-formed toner image on the transfer material 8 is fixed by the fixing device 14. Although the process cartridges are arranged in the order of yellow, magenta, cyan and black as described above, they may be arranged in any order.

Normally, a color image forming apparatus is configured to be large due to a number of image forming portions provided therein. Moreover, when the cleaning device 6, the charging means 2 or other unit breaks down individually or when the time for replacement comes at the end of life of a broken unit, replacement of the unit is extremely troublesome due to the complicated apparatus. Therefore, by integrally combining the components such as the photoreceptor, charging means and developing means to configure the process cartridge as in the present embodiment, it becomes possible to provide a small and highly-durable color image forming apparatus in which replacement can be performed by the user.

The present invention can inhibit the occurrence of noise generated by stick-slip between the blade member of the cleaning device and the image carrier.

Various modifications will become possible for those skilled in the art after receiving the teachings of the present disclosure, without departing from the scope thereof.

What is claimed is:

1. A cleaning device, comprising:

a blade member configured to come into sliding contact with a surface of an image carrier forming thereon a toner image and thereby cleans toner remaining on the surface of the image carrier;

a holder that holds the blade member;

a vibration detection device that detects vibration of the blade member;

an excitation member that vibrates the blade member, wherein the vibration detection device and the excitation member are attached to the blade member or the holder; and a control device operatively connected to each of the vibration detection device and the excitation member that causes the excitation member to vibrate at least one of the blade member and the holder when the level of vibration detected by the vibration detection device exceeds a set threshold value.

2. The cleaning device as claimed in claim 1, wherein the vibration detection device is a piezoelectric element.

3. The cleaning device as claimed in claim 1, wherein the excitation member is a piezoelectric element.

4. The cleaning device as claimed in claim 1, wherein a frequency of vibration caused by the excitation member is at least 20 kHz.

5. The cleaning device as claimed in claim 1, wherein the excitation member is attached to the blade member over the entire length thereof in a direction along a sliding contact surface between the blade member and the image carrier.

6. The cleaning device as claimed in claim 1, wherein the vibration caused by the excitation member expands in a direction in which the blade member moves toward the image carrier.

7. The cleaning device as claimed in claim 1, wherein the control device further includes a vibration detector connected to the vibration detection device, wherein the vibration detector is configured to time-sequentially output an intensity of vibration detected by the vibration detection device to an analog/digital (A/D) converter.

8. The cleaning device as claimed in claim 7, wherein the control device further includes a vibration level determination portion connected to the vibration detector and configured to output an exceeding amount of vibration intensity above the threshold value to an excitation controller.

9. The cleaning device as claimed in claim 8, wherein the excitation controller is configured to drive the excitation member to vibrate the blade member.

10. A process cartridge, comprising:

an image carrier forming thereon a toner image;

a cleaning device having a blade member in sliding contact with a surface of the image carrier to clean toner remaining at least on the surface of the image carrier and a holder for holding the blade member;

a vibration detection device that detects vibration of the blade member;

an excitation member that vibrates the blade member, wherein the vibration detection device and the excitation member are attached to the blade member or the holder, and the cleaning device includes a control device configured to cause the excitation member to vibrate at least one of the blade member and the holder when a level of vibration detected by the vibration detection device exceeds a set threshold value.

11. An image forming apparatus, comprising:

an image carrier forming thereon a toner image;

a cleaning device that has a blade member in sliding contact with a surface of the image carrier to clean toner remaining on the surface of the image carrier and a holder for holding the blade member;

a vibration detection device that detects vibration of the blade member;

an excitation member that vibrates the blade member, wherein the vibration detection device and the excitation member are attached to the blade member or the holder, and the cleaning device includes a control device configured to cause the excitation member to vibrate at least one of the blade member and the holder when a level of vibration detected by the vibration detection device exceeds a set threshold value.

12. The image forming apparatus as claimed in claim 11, further including a plurality of image carriers, the plurality of image carriers forming toner images of different colors, and each of the plurality of image carriers includes the cleaning device therein.

* * * * *